US010830552B1

(12) United States Patent
Pineda

(10) Patent No.: US 10,830,552 B1
(45) Date of Patent: Nov. 10, 2020

(54) CLEANING DEVICE FOR BARREL OF PAINTBALL GUN

(71) Applicant: HK Army Inc., Gardena, CA (US)

(72) Inventor: Jason Jeremiah Pineda, Gardena, CA (US)

(73) Assignee: HK Army Inc., Gardena, CA (US)

( * ) Notice: Subject to any disclaimer, the term of this patent is extended or adjusted under 35 U.S.C. 154(b) by 0 days.

(21) Appl. No.: 16/872,862

(22) Filed: May 12, 2020

(51) Int. Cl.

| | |
|---|---|
| ***F41A 29/02*** | (2006.01) |
| ***F41B 11/70*** | (2013.01) |
| ***B08B 9/027*** | (2006.01) |
| ***A46B 5/00*** | (2006.01) |
| ***A47L 13/16*** | (2006.01) |

(52) U.S. Cl.
CPC ..... *F41A 29/02* (2013.01); *A46B 5/0037* (2013.01); *A46B 5/0054* (2013.01); *A47L 13/16* (2013.01); *B08B 9/027* (2013.01); *F41B 11/70* (2013.01); *A46B 2200/3013* (2013.01); *A46B 2200/3073* (2013.01)

(58) Field of Classification Search
CPC . F41A 29/02; F41A 29/00; B08B 9/02; B08B 9/027; B08B 9/04; A47L 13/12; A47L 13/16; A46B 5/0016; A46B 5/002; A46B 5/0037; A46B 5/0054; A46B 2200/3013; A46B 2200/3073
USPC ..... 42/95; 15/104.05, 104.16; 604/1
See application file for complete search history.

(56) References Cited

U.S. PATENT DOCUMENTS

| | | | | |
|---|---|---|---|---|
| 7,377,003 | B1 * | 5/2008 | Dochterman | F41B 11/00 15/104.15 |
| 8,176,592 | B1 * | 5/2012 | Carpenter | F41A 29/02 15/104.165 |
| 9,046,314 | B2 * | 6/2015 | Frederick | F41A 15/22 |
| 9,638,486 | B2 * | 5/2017 | Evans | F41A 29/02 |
| 2018/0257118 | A1 * | 9/2018 | Pineda | F41A 29/02 |

* cited by examiner

*Primary Examiner* — Orlando E Aviles
*Assistant Examiner* — Robert F Neibaur
(74) *Attorney, Agent, or Firm* — Knobbe, Martens, Olson & Bear, LLP

(57) ABSTRACT

A swab device for cleaning the barrel of a paintball gun has a first shaft, a second shaft and a flexible connector overmolded over ends of the first and second shafts to fixedly couple the flexible connector to the first and second shafts. Absorbent material can be disposed over the first and second rods. The flexible connector can be made of rubber or silicone. The flexible connector is configured to flex and to automatically return to an original linear orientation after the flexible connector has been flexed. The flexible connector can have one or more openings on a surface thereof that facilitate flexion of the flexible connector.

17 Claims, 6 Drawing Sheets

CLEANING DEVICE FOR BARREL OF PAINTBALL GUN

INCORPORATION BY REFERENCE TO ANY PRIORITY APPLICATIONS

Any and all applications for which a foreign or domestic priority claim is identified in the Application Data Sheet as filed with the present application are hereby incorporated by reference under 37 CFR 1.57.

BACKGROUND

Field

Aspects of the present disclosure are directed to a cleaning device for paintball equipment, and in particular to a cleaning device for the barrel of a paintball gun.

Description of the Related Art

Paintball is a popular sport, where balls filled with paint (i.e., "paintballs") are shot through a barrel of a paintball gun, usually a pneumatically actuated gun. The paintballs break when they strike a surface (e.g., a target, a competitor in a paintball match) after having been expelled from the barrel of the paintball gun. Sometimes, paintballs break within the barrel of the gun and negatively affect the accuracy of the paintball gun until the barrel of the paintball gun is cleaned to remove the broken paintball material from the barrel.

SUMMARY

Accordingly, there is a need for an improved cleaning device for removing broken paintballs from the barrel of a paintball gun.

In accordance with one aspect of the disclosure, a cleaning device (e.g., swab) is provided. The cleaning device comprises a first rod (e.g., shaft, stick) that optionally has an absorbent material (e.g., a fuzzy or felt like material, foam or sponge like material, fabric of natural or synthetic fibers) wrapped about at least a portion of the first rod to define a first rod assembly. The cleaning device also comprises a second rod (e.g., shaft, stick) that optionally has an absorbent material (e.g., a fuzzy or felt like material, foam or sponge like material, fabric of natural or synthetic fibers) wrapped about at least a portion of the second rod to define a second rod assembly. The first and second rods are connected by a flexible connecting member (e.g., connector) that is overmolded over ends of the first and second rods and provides a flexible joint. The first and second rods extend from opposite sides of the flexible connecting member, and the flexible connecting member can be flexed (e.g., bent) to pivot the rods between a first position where the first and second rods extend generally along a single axis (e.g., are in line, extend linearly), to a second position, where the first rod extends at an angle less than 180 degrees relative to the second rod, where the cleaning device bends at the flexible joint.

In accordance with another aspect of the disclosure, a cleaning assembly for a paintball gun barrel is provided. The assembly comprises a first shaft having longitudinal axis and extending from a proximal portion to a distal portion, and a second shaft having a longitudinal axis and extending from a proximal portion to a distal portion. The assembly also comprises a connector overmolded over ends of the first and second shafts. The connector is fixed to the proximal portions of the first and second shafts. The connector has an opening (e.g., oval opening) on one or more surfaces of the connector and defines a hinge generally at a longitudinal center of the connector that is configured to allow pivoting of the first shaft relative to the second shaft. An absorbent material is disposed over one or both of the first shaft and the second shaft and is configured to contact an inner surface of a barrel of a paintball gun when inserted therein.

In accordance with another aspect of the disclosure, a cleaning swab for a paintball gun barrel is provided. The swab comprises a first shaft having longitudinal axis and extending from a proximal portion to a distal portion, and a second shaft having a longitudinal axis and extending from a proximal portion to a distal portion. The swab also comprises a flexible connector overmolded over the proximal portions of the first and second shafts to fixedly couple the flexible connector to the first and second shafts, the flexible connector configured to flex and to automatically return to an original linear orientation after the flexible connector has been flexed. The first and second shafts are sized to be insertable in a barrel of a paintball gun to clean the barrel from paint and debris.

In accordance with another aspect of the disclosure, a cleaning swab for a paintball gun barrel is provided. The swab comprises a first rod having longitudinal axis and extending from a proximal portion to a distal portion, a first absorbent material disposed over the first rod, a second rod having a longitudinal axis and extending from a proximal portion to a distal portion, and a second absorbent material disposed over the second rod. The swab also comprises a flexible connector overmolded over the proximal portions of the first and second rods to fixedly couple the flexible connector to the first and second rods, the flexible connector having one or more openings that facilitate flexion of the flexible connector, the flexible connector configured to automatically return to an original linear orientation after the flexible connector has been flexed. The first and second rods are sized to be insertable in a barrel of a paintball gun to clean the barrel from paint and debris.

In accordance with another aspect of the disclosure, a cleaning swab for a gun barrel is provided. The swab comprises a first rod having longitudinal axis and extending from a proximal portion to a distal portion, a first absorbent material disposed over the first rod, a second rod having a longitudinal axis and extending from a proximal portion to a distal portion, and a second absorbent material disposed over the second rod. The swab also comprises a flexible connector overmolded over the proximal portions of the first and second rods to fixedly couple the flexible connector to the first and second rods, the flexible connector having one or more openings that facilitate flexion of the flexible connector, the flexible connector configured to automatically return to an original linear orientation after the flexible connector has been flexed. The first and second rods are sized to be insertable in a barrel of a gun to clean the barrel from debris.

DETAILED DESCRIPTION

Figure 1:
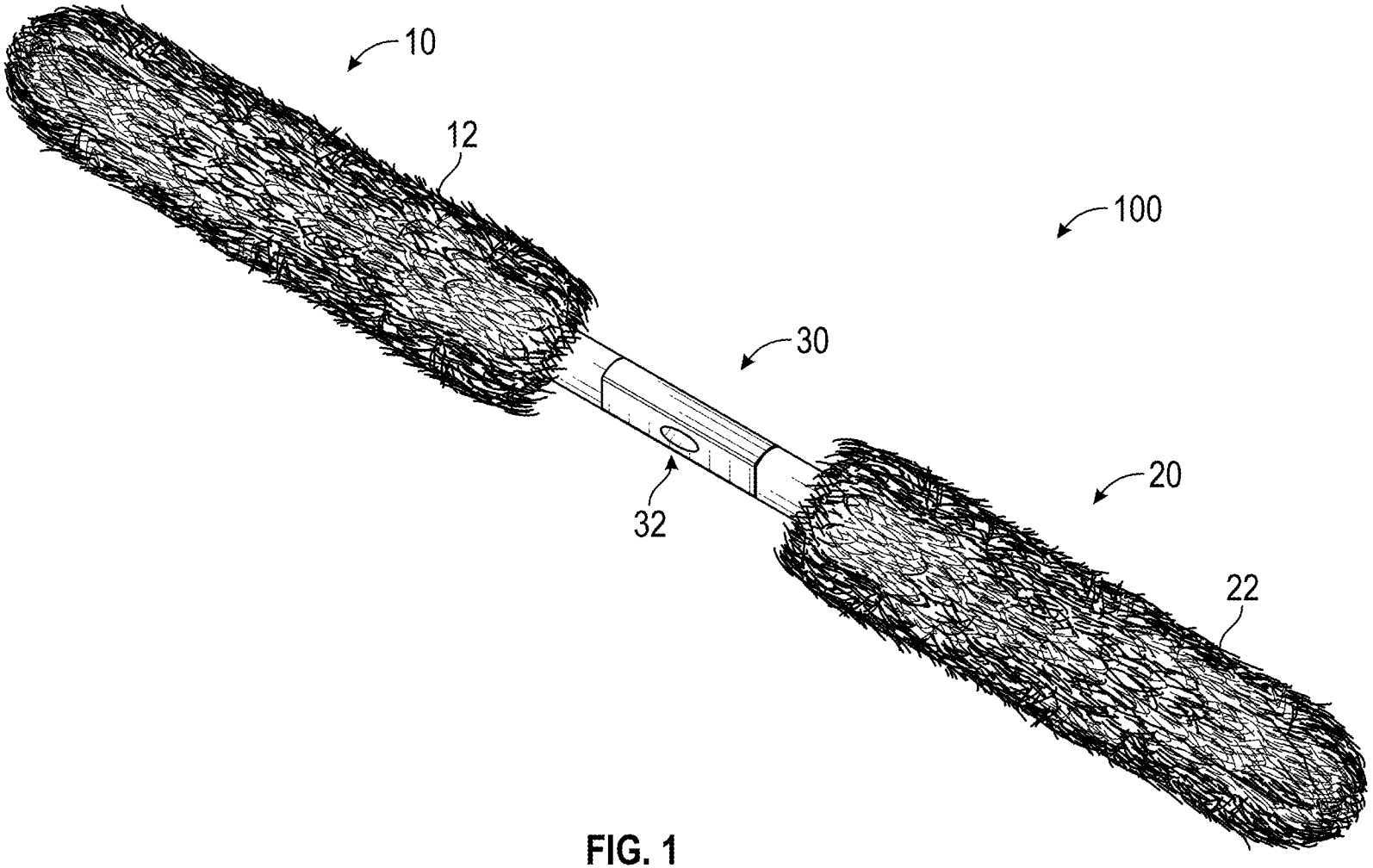
FIG. 1 is a perspective view of a cleaning device.
Figure 2:
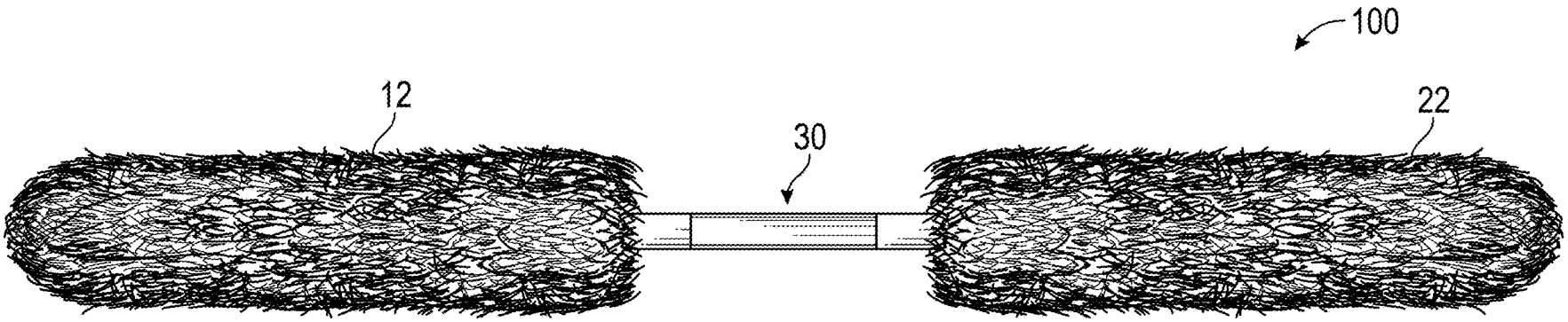
FIG. 2 is a top view of the cleaning device.
Figure 3:
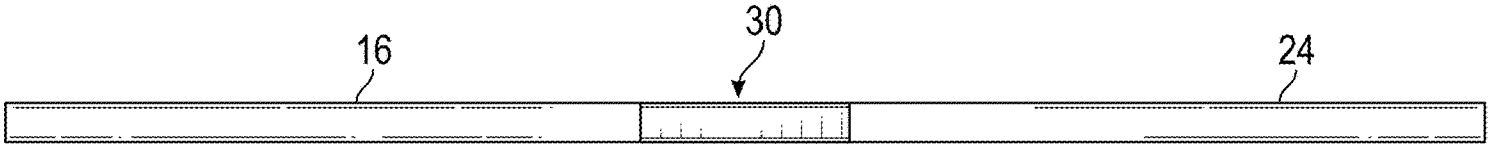
FIG. 3 is a top view of the cleaning device with the absorbent material removed from the rods.
Figure 4:
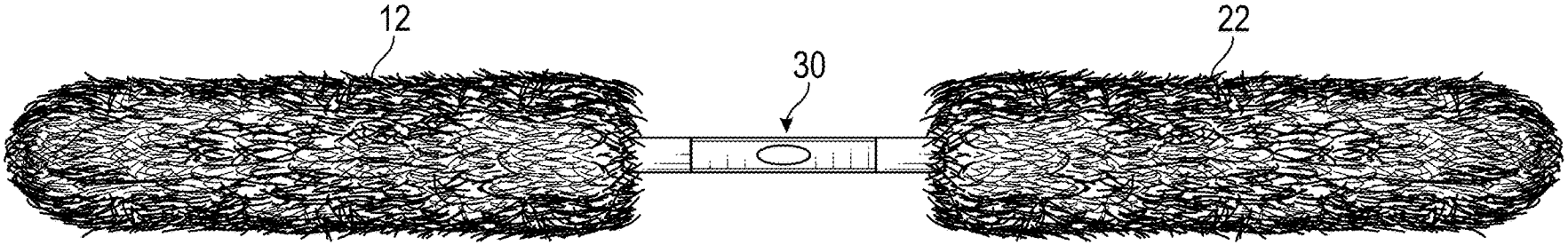
FIG. 4 is a side view of the cleaning device in FIG. 1.

FIGS. 1-4 show a cleaning device 100 or swab for use in cleaning the barrel of a paintball gun, for example to remove broken paintball material from the barrel. Though described in connection with the cleaning of a barrel of a paintball gun, the cleaning device 100 or swab can be used to clean barrels in other devices (e.g., firearms, gun).

The cleaning device 100 can have a first rod assembly 10 (e.g., first shaft or stick) and a second rod assembly 20 (e.g., second shaft or stick) connected to a flexible connecting member 30. The flexible connecting member 30 is approximately halfway along the length of the cleaning device 100. The flexible connecting member 30 can be overmolded (e.g., during a manufacturing process) over ends of the first and second rod assemblies 10, 20. The flexible connecting member 30 is therefore permanently connected to (e.g., adhered to, fused with) the first and second rod assemblies 10, 20 (e.g., the flexible connecting member 30 cannot be readily detached from the ends of the first and second rod assemblies 10, 20).

In one implementation, the ends of the rod assemblies 10, 20 over which the flexible connecting member 30 is overmolded can have a substantially smooth surface. In another implementation, the ends of the rod assemblies 10, 20 over which the flexible connecting member 30 is overmolded can have a rough, barbed or discontinuous surface to further inhibit detachment of the connecting member 30 from the rod assemblies 10, 20.

In one implementation, the flexible connecting member 30 can be made of rubber. In another implementation, the flexible connecting member 30 can be made of silicone. However, the flexible connecting member 30 can be made of other suitable materials that allow the connecting member 30 to be flexed (e.g. bent) and to automatically return to (e.g., snap back to) its original position (e.g., linear orientation) after it has been bent The flexible connecting member 30 can have one or more openings 32 in at least one surface (e.g., in two opposite surfaces) of the connecting member 30 that facilitate the flexing (e.g., bending) of the flexible connecting member 40. In one implementation, the one or more openings 32 can have a substantially oval shape with a major axis extending along the longitudinal axis of the flexible connecting member 30 and a minor axis extending along an axis perpendicular to the longitudinal axis of the flexible connecting member 30. In one implementation, the connecting member 30 can have substantially oval openings 32 on two opposite surfaces of the connecting member 30. The substantially oval opening 32 can have a width of between about 4 mm and 6 mm (e.g., 5 mm) and a length of between about 9 mm and about 13 mm (e.g., 11 mm). Advantageously, the oval shape of the one or more openings 32 facilitate the easy flexing (e.g., bending) of the connecting member 30. Advantageously, the connecting member 30 is flexible, strong and can automatically return to (e.g., snap back to) its original position (e.g., linear orientation) after it has been bent. The flexible connecting member 30 can provide a flexible joint between the first and second rod assemblies 10, 20, allowing the rod assemblies 10, 20 to be moved between a first position where the first and second rod assemblies are aligned (e.g., extend along an axis) and a second position where the first and second rod assemblies 10, 20 extends at an angle less than 180 degrees relative to each other.

The first rod assembly 10 can include an absorbent material 12 wrapped about at least a portion of a first rod (e.g., a shaft or stick) 16. Optionally, the absorbent material 12 is wrapped about a majority of the length of the first rod 16.

The second rod assembly 20 can include an absorbent material 22 wrapped about at least a second rod (e.g., a shaft or stick) 24. Optionally, the absorbent material 22 is wrapped about a majority of the length of the second rod 24.

Figure 5A:
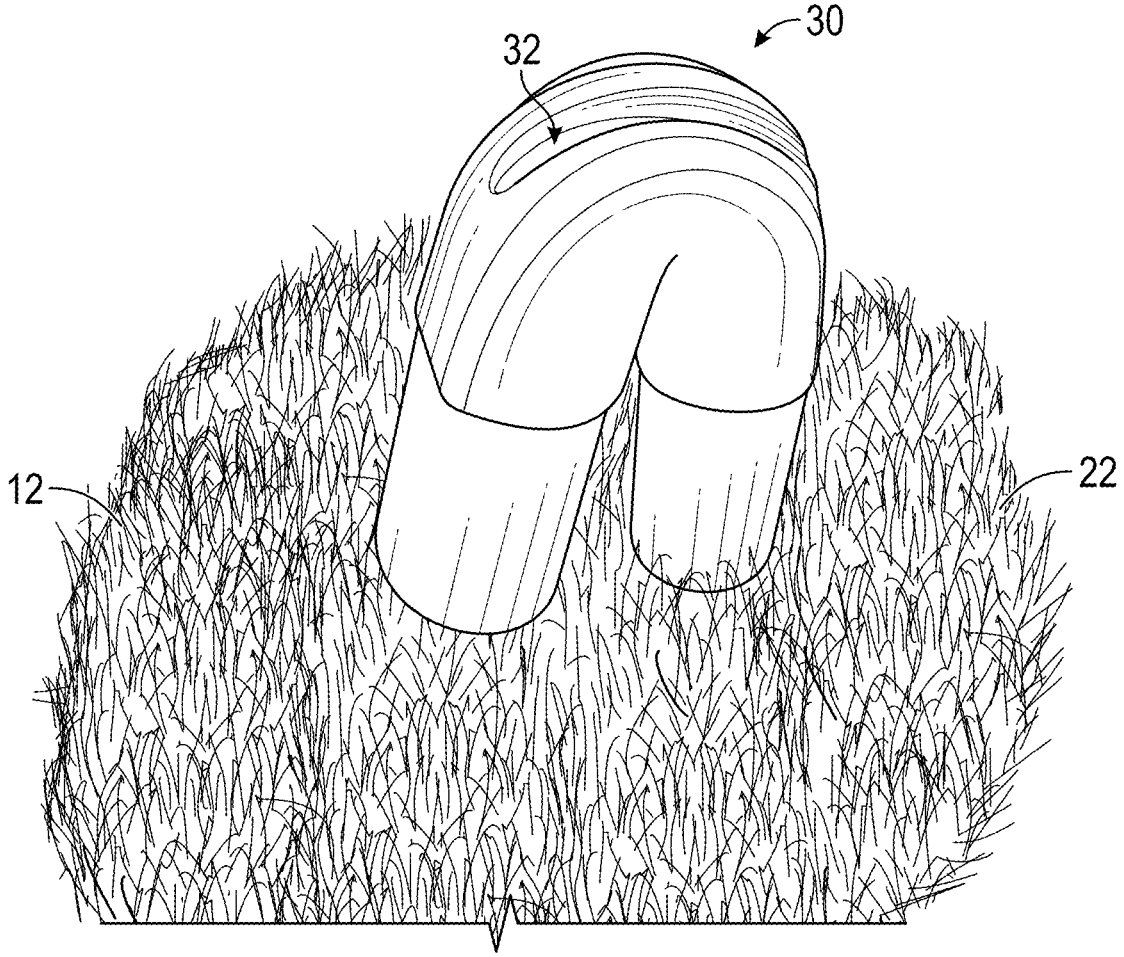
FIG. 5A is a perspective view of a portion of the cleaning device with the flexible joint in the bent position.
Figure 5B:
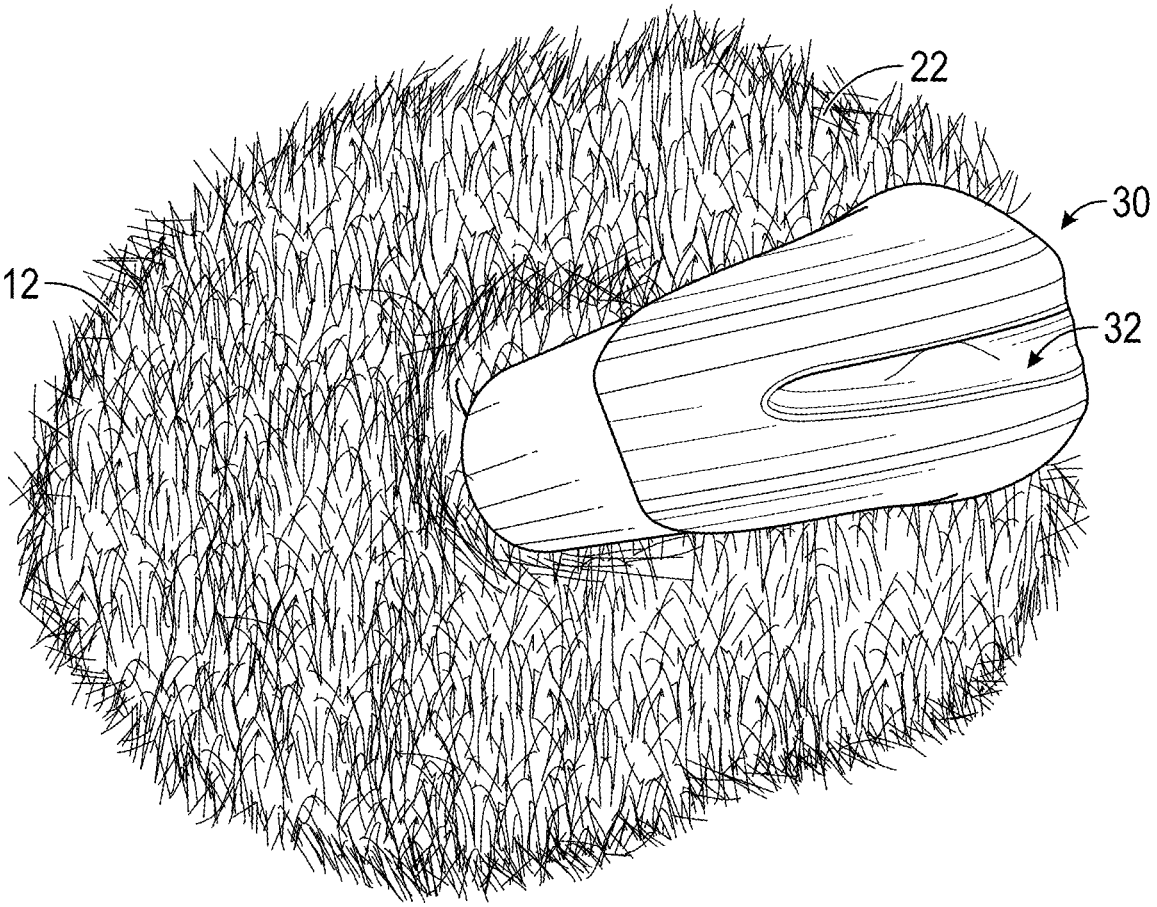
FIG. 5B is another perspective view of a portion of the cleaning device with the flexible joint in the bent position.
Figure 5C:
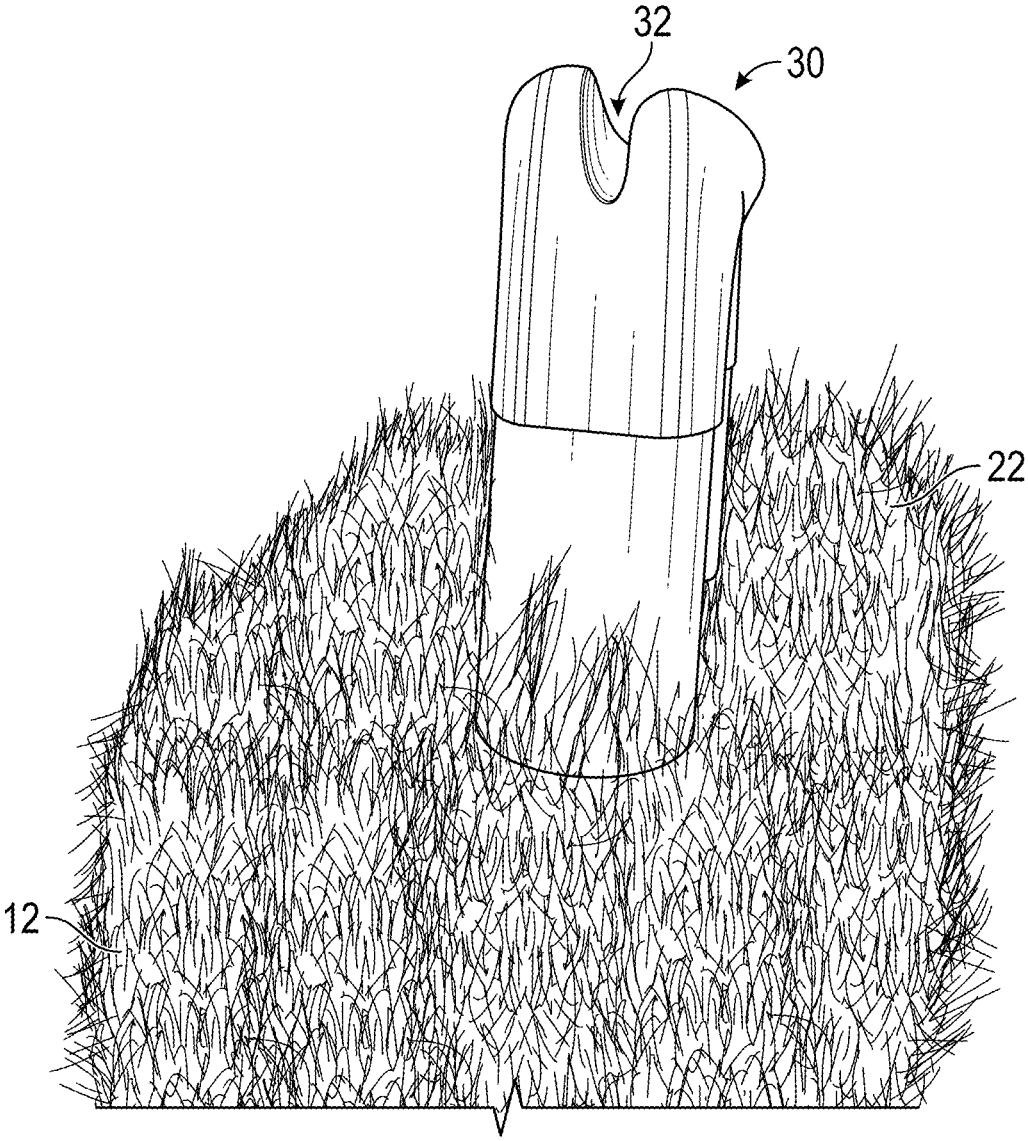
FIG. 5C is a side view of a portion of the cleaning device with the flexible joint in the bent position.
Figure 6:
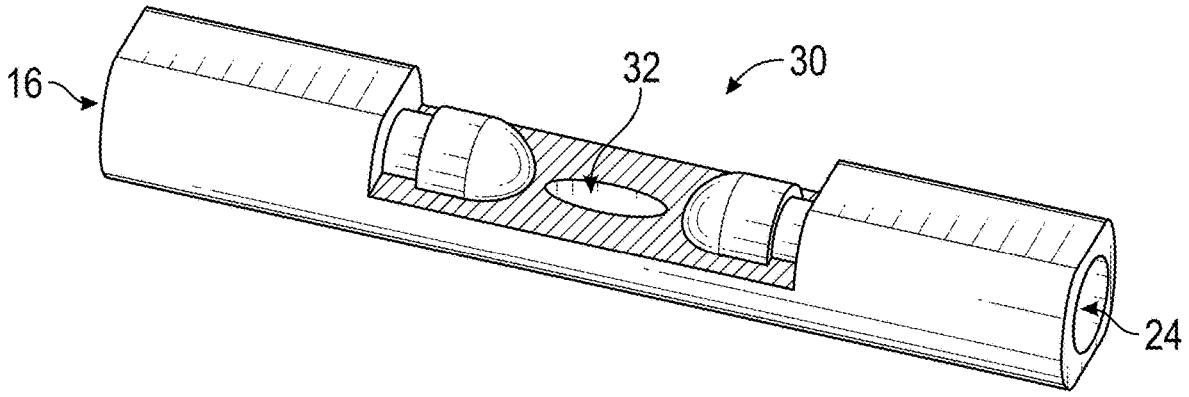
FIG. 6 is a partial view of the cleaning device of FIG. 1 with a portion of the overmolded flexible connecting member removed to expose ends of the rods over which the flexible connecting member is overmolded.

FIGS. 5A-5B show the flexible connecting member 30 in a flexed or bent position. The one or more openings 32 define a hinge along which the connecting member 30 flexes. FIG. 6 shows a partial view of the cleaning device or swab 100 with a portion of the flexible connecting member 30 removed to expose the ends of the rods 16, 24 over which the flexible connecting portion 30 is overmolded. The ends of the rods 16, 24 can have a stepped diameter portion with a larger diameter than the rest of the rods 16, 24 and a curved (e.g., hemispherical) end. The opening 32 is defined in the flexible connecting portion 30 between the ends of the rods 16, 24.

In operation, a user would insert the second rod assembly 20 into the barrel of the paintball gun so that the absorbent material 22 contacts the inner surface of the barrel and can absorb paint and debris from inside the barrel (e.g. from the inner surface of the barrel). The user would then pull on the cleaning device 100 or swab to withdraw the second rod assembly 20 from the barrel, causing the absorbent material 22 to slide relative to the barrel and absorb paint and debris in the barrel and remove it from the barrel. Optionally, the user an rotate the cleaning device 100 and insert the first rod assembly 10 into the barrel of the paintball gun to continue to clean the barrel with the absorbent material 12 of the first rod assembly 10.

While certain embodiments of the inventions have been described, these embodiments have been presented by way of example only, and are not intended to limit the scope of the disclosure. Indeed, the novel methods and systems described herein may be embodied in a variety of other forms. Furthermore, various omissions, substitutions and changes in the systems and methods described herein may be made without departing from the spirit of the disclosure. The accompanying claims and their equivalents are intended to cover such forms or modifications as would fall within the scope and spirit of the disclosure. Accordingly, the scope of the present inventions is defined only by reference to the appended claims.

Features, materials, characteristics, or groups described in conjunction with a particular aspect, embodiment, or example are to be understood to be applicable to any other aspect, embodiment or example described in this section or elsewhere in this specification unless incompatible therewith. All of the features disclosed in this specification (including any accompanying claims, abstract and drawings), and/or all of the steps of any method or process so disclosed, may be combined in any combination, except combinations where at least some of such features and/or steps are mutually exclusive. The protection is not restricted to the details of any foregoing embodiments. The protection extends to any novel one, or any novel combination, of the features disclosed in this specification (including any accompanying claims, abstract and drawings), or to any novel one, or any novel combination, of the steps of any method or process so disclosed.

Furthermore, certain features that are described in this disclosure in the context of separate implementations can also be implemented in combination in a single implementation. Conversely, various features that are described in the context of a single implementation can also be implemented in multiple implementations separately or in any suitable subcombination. Moreover, although features may be described above as acting in certain combinations, one or more features from a claimed combination can, in some cases, be excised from the combination, and the combination may be claimed as a subcombination or variation of a subcombination.

Moreover, while operations may be depicted in the drawings or described in the specification in a particular order, such operations need not be performed in the particular order shown or in sequential order, or that all operations be performed, to achieve desirable results. Other operations that are not depicted or described can be incorporated in the example methods and processes. For example, one or more additional operations can be performed before, after, simultaneously, or between any of the described operations. Further, the operations may be rearranged or reordered in other implementations. Those skilled in the art will appreciate that in some embodiments, the actual steps taken in the processes illustrated and/or disclosed may differ from those shown in the figures. Depending on the embodiment, certain of the steps described above may be removed, others may be added. Furthermore, the features and attributes of the specific embodiments disclosed above may be combined in different ways to form additional embodiments, all of which fall within the scope of the present disclosure. Also, the separation of various system components in the implementations described above should not be understood as requiring such separation in all implementations, and it should be understood that the described components and systems can generally be integrated together in a single product or packaged into multiple products.

For purposes of this disclosure, certain aspects, advantages, and novel features are described herein. Not necessarily all such advantages may be achieved in accordance with any particular embodiment. Thus, for example, those skilled in the art will recognize that the disclosure may be embodied or carried out in a manner that achieves one advantage or a group of advantages as taught herein without necessarily achieving other advantages as may be taught or suggested herein.

Conditional language, such as "can," "could," "might," or "may," unless specifically stated otherwise, or otherwise understood within the context as used, is generally intended to convey that certain embodiments include, while other embodiments do not include, certain features, elements, and/or steps. Thus, such conditional language is not generally intended to imply that features, elements, and/or steps are in any way required for one or more embodiments or that one or more embodiments necessarily include logic for deciding, with or without user input or prompting, whether these features, elements, and/or steps are included or are to be performed in any particular embodiment.

Conjunctive language such as the phrase "at least one of X, Y, and Z," unless specifically stated otherwise, is otherwise understood with the context as used in general to convey that an item, term, etc. may be either X, Y, or Z. Thus, such conjunctive language is not generally intended to imply that certain embodiments require the presence of at least one of X, at least one of Y, and at least one of Z.

Language of degree used herein, such as the terms "approximately," "about," "generally," and "substantially" as used herein represent a value, amount, or characteristic close to the stated value, amount, or characteristic that still performs a desired function or achieves a desired result. For example, the terms "approximately", "about", "generally," and "substantially" may refer to an amount that is within less than 10% of, within less than 5% of, within less than 1% of, within less than 0.1% of, and within less than 0.01% of the stated amount. As another example, in certain embodiments, the terms "generally parallel" and "substantially parallel" refer to a value, amount, or characteristic that departs from exactly parallel by less than or equal to 15 degrees, 10 degrees, 5 degrees, 3 degrees, 1 degree, or 0.1 degree.

The scope of the present disclosure is not intended to be limited by the specific disclosures of preferred embodiments in this section or elsewhere in this specification, and may be defined by claims as presented in this section or elsewhere in this specification or as presented in the future. The language of the claims is to be interpreted broadly based on the language employed in the claims and not limited to the examples described in the present specification or during the prosecution of the application, which examples are to be construed as non-exclusive.

Of course, the foregoing description is that of certain features, aspects and advantages of the present invention, to which various changes and modifications can be made without departing from the spirit and scope of the present invention. Moreover, the devices described herein need not feature all of the objects, advantages, features and aspects discussed above. Thus, for example, those of skill in the art will recognize that the invention can be embodied or carried out in a manner that achieves or optimizes one advantage or a group of advantages as taught herein without necessarily achieving other objects or advantages as may be taught or suggested herein. In addition, while a number of variations of the invention have been shown and described in detail, other modifications and methods of use, which are within the scope of this invention, will be readily apparent to those of skill in the art based upon this disclosure. It is contemplated that various combinations or subcombinations of these specific features and aspects of embodiments may be made and still fall within the scope of the invention. Accordingly, it should be understood that various features and aspects of the disclosed embodiments can be combined with or substituted for one another in order to form varying modes of the discussed devices.

What is claimed is:

1. A cleaning swab for a paintball gun barrel, comprising:

a first shaft extending along a first length from a first proximal portion to a first distal portion;

a second shaft extending along a second length from a second proximal portion to a second distal portion; and a flexible connector over the first and second proximal portions of the first and second shafts to fixedly couple the flexible connector to the first and second shafts, the flexible connector configured comprising an elastic material that allows the connector to flex and to automatically return to an original linear orientation after the flexible connector has been flexed, the flexible connector having one or more oval openings, the one or more oval openings having a length greater than a width, the length of the one or more oval openings defined along a major axis that extends along a longitudinal axis of the flexible connector, the width of the one or more oval openings defined along a minor axis that extends along an axis perpendicular to the longitudinal axis of the flexible connector, wherein the first and second shafts are sized to be insertable separately in a barrel of a paintball gun to clean the barrel from paint and debris.

2. The swab of claim 1, wherein the flexible connector is made of a material chosen from the group consisting of rubber and silicone.

3. The swab of claim 1, wherein the one or more oval openings define a hinge of the flexible connector.

4. The swab of claim 1, wherein one or more oval openings are a pair of openings on opposite surfaces of the flexible connector.

5. The swab of claim 1, wherein the openings define a passage within the flexible connector.

6. The swab of claim 1, further comprising an absorbent material disposed over a majority of a length of the first shaft and a majority of a length of the second shaft.

7. The swab of claim 1, wherein the flexible connector is overmolded over the first and second proximal portions of the first and second shafts.

8. A cleaning swab for a paintball gun barrel, comprising:

a first rod extending along a first length from a first proximal portion to a first distal portion;

a first absorbent material disposed over the first rod;

a second rod extending along a second length from a second proximal portion to a second distal portion;

a second absorbent material disposed over the second rod; and a flexible connector over the first and second proximal portions of the first and second rods to fixedly couple the flexible connector to the first and second rods, the flexible connector having a pair of openings on opposite sides of the flexible connector that facilitate flexion of the flexible connector, the flexible connector configured to automatically return to an original linear orientation after the flexible connector has been flexed, a passage defined within a body of the flexible connector between the pair of openings and in a direction generally transverse to a longitudinal axis of the flexible connector, wherein the first and second rods are sized to be insertable separately in a barrel of a paintball gun to clean the barrel from paint and debris.

9. The swab of claim 8, wherein the flexible connector is made of a material chosen from the group consisting of rubber and silicone.

10. The swab of claim 8, wherein the pair of openings are a pair of oval openings.

11. The swab of claim 10, wherein the pair of oval openings have a major axis extending along a longitudinal axis of the flexible connector and a minor axis extending along an axis perpendicular to the longitudinal axis.

12. The swab of claim 8, wherein the flexible connector is overmolded over the first and second proximal portions of the first and second rods.

13. A cleaning swab for a gun barrel, comprising:

a first rod extending along a first length from a first proximal portion to a first distal portion;

a second rod extending along a second length from a second proximal portion to a second distal portion; and a flexible connector disposed over the first and second proximal portions of the first and second rods, the flexible connector having a pair of openings on opposite sides of the flexible connector that facilitate flexion of the flexible connector, the flexible connector configured to automatically return to an original linear orientation after the flexible connector has been flexed, a passage defined within a body of the flexible connector between the pair of openings and in a direction generally transverse to a longitudinal axis of the flexible connector, wherein the first and second rods are sized to be insertable separately in a barrel of a gun to clean the barrel from debris.

14. The swab of claim 13, wherein the flexible connector is made of a material chosen from the group consisting of rubber and silicone.

15. The swab of claim 13, wherein the pair of openings are a pair of oval openings.

16. The swab of claim 15, wherein the pair of oval openings have a major axis extending along a longitudinal axis of the flexible connector and a minor axis extending along an axis perpendicular to the longitudinal axis.

17. The swab of claim 13, wherein the flexible connector is overmolded over the first and second proximal portions of the first and second rods.

* * * * *